US009534874B2

(12) United States Patent
Alford et al.

(10) Patent No.: US 9,534,874 B2
(45) Date of Patent: Jan. 3, 2017

(54) LINEAR SHAPED CHARGES

(71) Applicant: Alford Research Limited, Chippenham, Wiltshire (GB)

(72) Inventors: Roland Takeshi Alford, Yambrook (GB); John Quentin Killip, Corsham (GB); Matthew James Eades, Bradford on Avon (GB)

(73) Assignee: Alford Research Limited, Chippenham, Wiltshire (GB)

( * ) Notice: Subject to any disclaimer, the term of this patent is extended or adjusted under 35 U.S.C. 154(b) by 0 days.

(21) Appl. No.: 14/612,174

(22) Filed: Feb. 2, 2015

(65) Prior Publication Data

US 2015/0219427 A1 Aug. 6, 2015

(30) Foreign Application Priority Data

Jan. 31, 2014 (GB) ..... 1401644.8

(51) Int. Cl.
*F42B 1/02* (2006.01)
*F42B 3/08* (2006.01)
*F42B 1/028* (2006.01)

(52) U.S. Cl.
CPC ..... *F42B 1/028* (2013.01)

(58) Field of Classification Search
CPC ..... F42B 1/00; F42B 1/02; F42B 1/028; F42B 1/036; F42B 3/006; F42B 3/02; F42B 3/08; F42B 33/008; F42B 33/02; F42B 33/0207; F42B 33/0228
USPC ..... 102/307
See application file for complete search history.

(56) References Cited

U.S. PATENT DOCUMENTS 2,513,233 A * 6/1950 Byers ..... F42B 1/02 102/306
2,587,243 A * 2/1952 Sweetman ..... F42B 1/02 102/307
2,587,244 A * 2/1952 Sweetman ..... E21B 29/02 102/320
2,758,543 A * 8/1956 Grandin ..... E21B 29/02 102/307
2,856,850 A * 10/1958 Church ..... F42B 1/02 102/307
2,897,714 A * 8/1959 Precoul ..... F42B 1/036 102/473
3,557,656 A * 1/1971 Precoul ..... F42B 1/02 102/332

(Continued)

FOREIGN PATENT DOCUMENTS

GB 2 221 285 A 1/1990
GB 2503186 A 12/2013

OTHER PUBLICATIONS

Search Report for UK Patent Application GB1401644.8, dated Jun. 13, 2014.

*Primary Examiner* — Bret Hayes
*Assistant Examiner* — Derrick Morgan
(74) *Attorney, Agent, or Firm* — McDonnell Boehnen Hulbert & Berghoff LLP

(57) ABSTRACT

A user-fillable linear shaped charge (10), comprising an elongate body (15) and a liner (30), in which the charge further comprises a cavity (50) adjacent at least part of the liner for receiving explosive material, the cavity comprising two elongate channels (50A, 50B) extending adjacent the liner, the body having a delivery opening (55) between the channels for receiving explosive material.

20 Claims, 17 Drawing Sheets

(56) References Cited

U.S. PATENT DOCUMENTS 3,561,361 A * 2/1971 Kessenich ..... F42B 1/024 102/307
3,777,663 A * 12/1973 Brown ..... F42B 3/08 102/306
3,855,929 A * 12/1974 Ridgeway ..... F42B 3/08 102/307
4,099,464 A * 7/1978 Cross ..... F42B 3/08 102/202.6
4,109,576 A * 8/1978 Eckels ..... F42B 1/02 102/307
4,126,092 A * 11/1978 Cross ..... F42B 1/02 102/307
4,148,257 A * 4/1979 Orrill ..... B26F 3/04 102/307
4,151,798 A * 5/1979 Ridgeway ..... F42B 3/08 102/307
4,222,329 A * 9/1980 Austin ..... F42B 1/02 102/305
4,342,261 A * 8/1982 Majerus ..... F42B 33/0207 102/307
4,348,957 A * 9/1982 White ..... F42B 15/38 102/378
4,418,622 A * 12/1983 Foster ..... F42B 1/02 102/289
4,430,939 A * 2/1984 Harrold ..... F42B 3/093 102/307
4,641,581 A * 2/1987 Weickert ..... F42B 3/24 102/307
4,649,824 A * 3/1987 Guay ..... F42B 15/38 102/307
4,693,181 A * 9/1987 Dadley ..... F42B 1/032 102/307
4,724,105 A * 2/1988 Owen ..... B26F 3/04 102/307
4,815,384 A * 3/1989 Ringel ..... F42B 3/08 102/307
5,010,823 A * 4/1991 Morrison ..... F42B 15/38 102/307
5,119,729 A * 6/1992 Nguyen ..... B22F 3/15 102/307
H1216 H * 8/1993 Vigil ..... F42B 3/08 102/306
5,415,101 A * 5/1995 Brinkmann ..... F42B 1/02 102/307
5,753,850 A * 5/1998 Chawla ..... F42B 1/02 102/307
5,859,383 A * 1/1999 Davison ..... C06B 25/34 102/307
5,936,184 A * 8/1999 Majerus ..... F42B 3/08 102/306
6,269,725 B1 * 8/2001 Cherry ..... F42B 1/02 102/306
6,378,438 B1 * 4/2002 Lussier ..... F42B 1/032 102/306
7,536,956 B2 * 5/2009 Sammons ..... C06B 45/00 102/306
8,904,934 B1 * 12/2014 Scheid ..... F42B 3/087 102/307
8,978,558 B2 * 3/2015 Lumley ..... F42B 1/036 102/307
8,985,024 B2 * 3/2015 Yang ..... F42B 1/032 102/306
2007/0053785 A1 * 3/2007 Hetz ..... E21B 43/117 419/42
2011/0146519 A1 * 6/2011 Han ..... F42B 1/02 102/332
2013/0014662 A1 * 1/2013 Lumley ..... C10B 49/10 102/307
2015/0013561 A1 * 1/2015 Chartier ..... C06C 5/04 102/307
2015/0345245 A1 * 12/2015 Bell ..... E21B 43/117 102/310

* cited by examiner

LINEAR SHAPED CHARGES

This application claims the benefit of priority of United Kingdom patent application no. GB 1401644.8, filed Jan. 31, 2014, which is hereby incorporated herein by reference in its entirety.

The present invention relates generally to shaped charges, which are explosive charges shaped to focus the effect of an explosive's energy, and particularly to linear shaped charges which are also known as linear cutting charges (LCC).

An LCC has a lining with generally V-shaped profile and varying length. Explosive is then loaded behind the lining and the explosive is encased within a suitable material that serves to protect the explosive and to confine (tamp) it on detonation. The charge is detonated at some point in the explosive above the lining apex. The detonation projects the lining to form a continuous, knife-like (planar) jet. The jet cuts material in its path, to a depth dependent on the size of the charge and materials used in the charge. LCCs are used, for example, in the cutting of rolled steel joists and other structural targets, such as in the controlled demolition of buildings.

Existing user-filled linear cutting charges require the user to stem explosive into the charge, ensuring that the explosive is in good contact with the liner. This requires considerable care and time, and the use of some kind of stemming tool to be achieved.

The present invention seeks to provides improvements over existing linear cutting charges.

According to an aspect of the present invention there is provided a user-fillable linear shaped charge, comprising an elongate body and a liner, in which the charge further comprises a cavity adjacent at least part of the liner for receiving explosive material, the cavity comprising two elongate channels extending adjacent the liner, the body having a delivery opening between the channels for receiving explosive material.

According to a further aspect there is provided a user-fillable linear shaped charge, comprising a body and a generally V-shape liner, in which the charge further comprises a cavity adjacent the liner for receiving explosive material, the cavity comprising two elongate channels extending adjacent the liner, the cavity having a delivery opening between the channels for receiving explosive material.

The channels may extend generally parallel to the liner.

A further aspect provides a user-fillable linear shaped charge, comprising a body and a liner provided on or by the body, in which the charge further comprises a cavity adjacent the liner for receiving explosive material, and a delivery opening for allowing user filling of the cavity.

The opening may comprise a filling chute, passage, hole, gap, aperture, space, orifice, slot, window, slit, mouth or the like. In some embodiments the opening extends along the entire length of the charge, for example being an elongate gap between rear walls of a pair of channels.

The opening may be adapted to receive blocks (whole blocks and/or cut blocks) of explosive material. The body of the charge may be formed and shaped such that the user simply slides fully packaged blocks of explosive into the body so that they are automatically held in place. Depending on the shape of the blocks and the channel the user may need to cut blocks to make them the right size for the channel. In some embodiments the channel is matched to known and predetermined block sizes.

The key to block-receiving embodiments of this type is to match the proportions of the cavity to the standard explosive block dimension.

In one embodiment a charge formed in accordance with the present invention was loaded in seconds by sliding in whole blocks of PE7 explosive and three half blocks of PE7 which were easily conformed to fit the cavity.

Not having to unwrap explosive, or to reform or stem the explosive is a significant benefit. It is also noted that with some explosives, such as C4, they are packed at a high density, but the act of reforming the explosive when it is unwrapped causes the density to be reduced from 1.6 g/cm$^3$ to 1.3 g/cm$^3$, which charges formed according to the present invention can avoid.

In some embodiments the charge has a sealed projectile unit. For example, in one embodiment the charge may be a welded, steel diamond cross section with welded ends which resist water pressure and prevent water from preventing jet formation.

The liner may be a separate component, for example a copper liner with an angle between 70 and 100 degrees. In other embodiments the liner may be an integral part of the body.

The liner may define part of the cavity.

The charge may further comprise a lid for covering the opening. In some embodiments a plastic lid is provided.

The body may include means for receiving a liner at plurality of positions. For example a multitude of rails into which a liner can be slid may be provided on or by the body. This would allow the channel width to be varied to accept different block sizes, e.g. PE7 or C4.

The charge may further comprise an end cap. The end cap may, for example, receive an initiator in use. It may also, for example, include means for interlocking the charge with other such charges in an array. The end cap may be fixable onto an end of the body, for example using a screw fixing or the like.

The charges can be made from folded metal or extruded from metal or plastic. The body may, for example, be formed from a metal or metal alloy material, for example aluminium which can be extruded into an elongate shape.

Depending on the material from which the charge is formed, in some embodiments an elongate charge can be cut to length, for example with a hacksaw.

A further aspect provides a body for a linear shaped charge, comprising an elongate body for receiving a liner, in which the charge further comprises a cavity for receiving explosive material so as to be adjacent at least part of a liner in use, the body having a delivery opening for receiving explosive material into the cavity.

The present invention also provides for a charge as shown and described herein and filled with explosive material.

The explosive material may be in block form.

The present invention also provides a method of loading a linear shaped charge with explosive material as shown and described herein.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims.

The present invention will now be more particularly described, by way of example, with reference to the accompanying drawings, in which.

Figure 1:
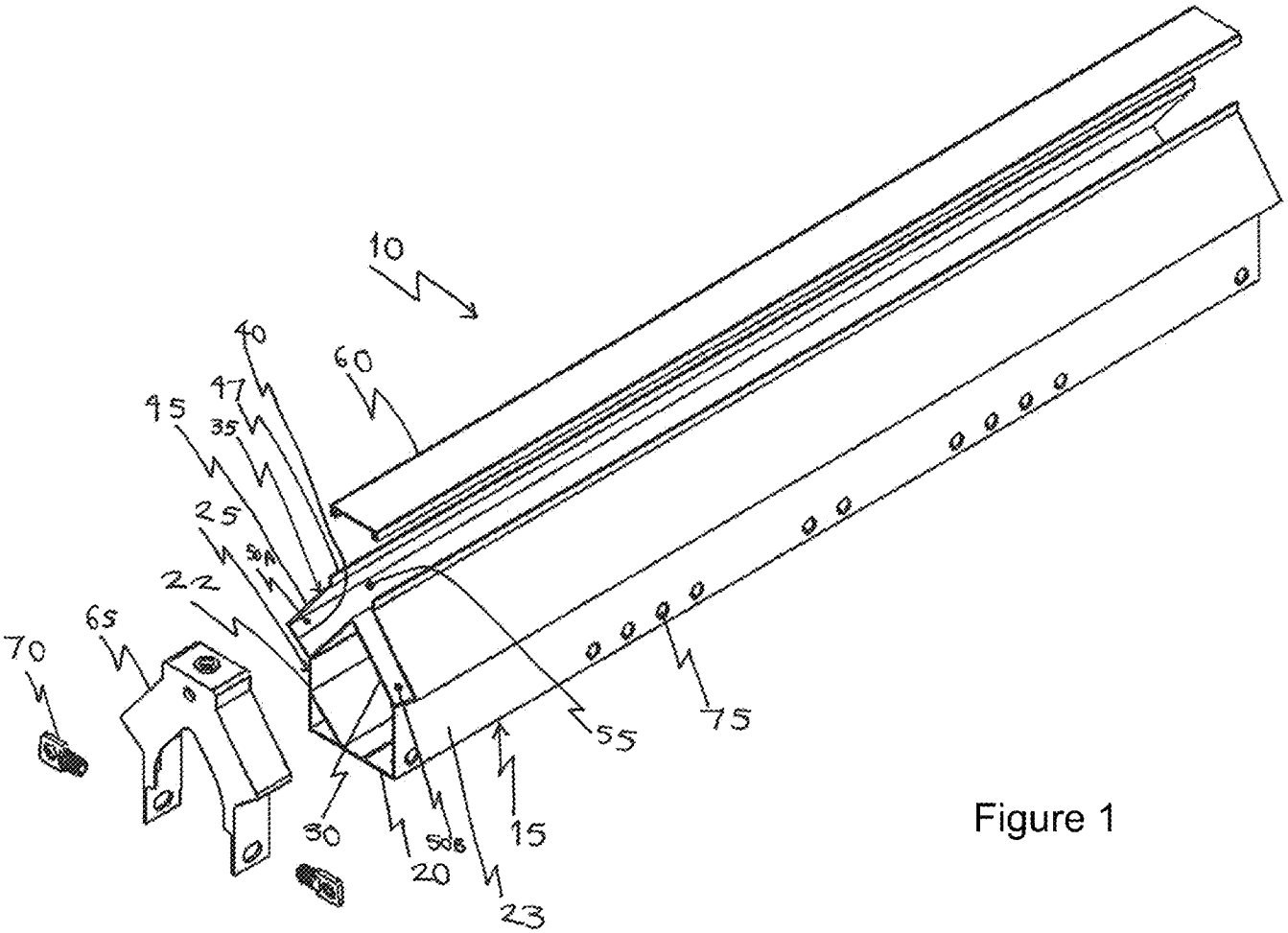
FIG. 1 is an exploded perspective view of a linear cutting charge formed in accordance with the present invention.

Example embodiments are described below in sufficient detail to enable those of ordinary skill in the art to embody and implement the systems and processes herein described. It is important to understand that embodiments can be provided in many alternate forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

The terminology used herein to describe embodiments is not intended to limit the scope. The articles "a," "an," and "the" are singular in that they have a single referent, however the use of the singular form in the present document should not preclude the presence of more than one referent. In other words, elements referred to in the singular can number one or more, unless the context clearly indicates otherwise. It will be further understood that the terms "comprises," "comprising," "includes," and/or "including," when used herein, specify the presence of stated features, items, steps, operations, elements, and/or components, but do not preclude the presence or addition of one or more other features, items, steps, operations, elements, components, and/or groups thereof.

Unless otherwise defined, all terms (including technical and scientific terms) used herein are to be interpreted as is customary in the art. It will be further understood that terms in common usage should also be interpreted as is customary in the relevant art and not in an idealized or overly formal sense unless expressly so defined herein.

Figure 2:
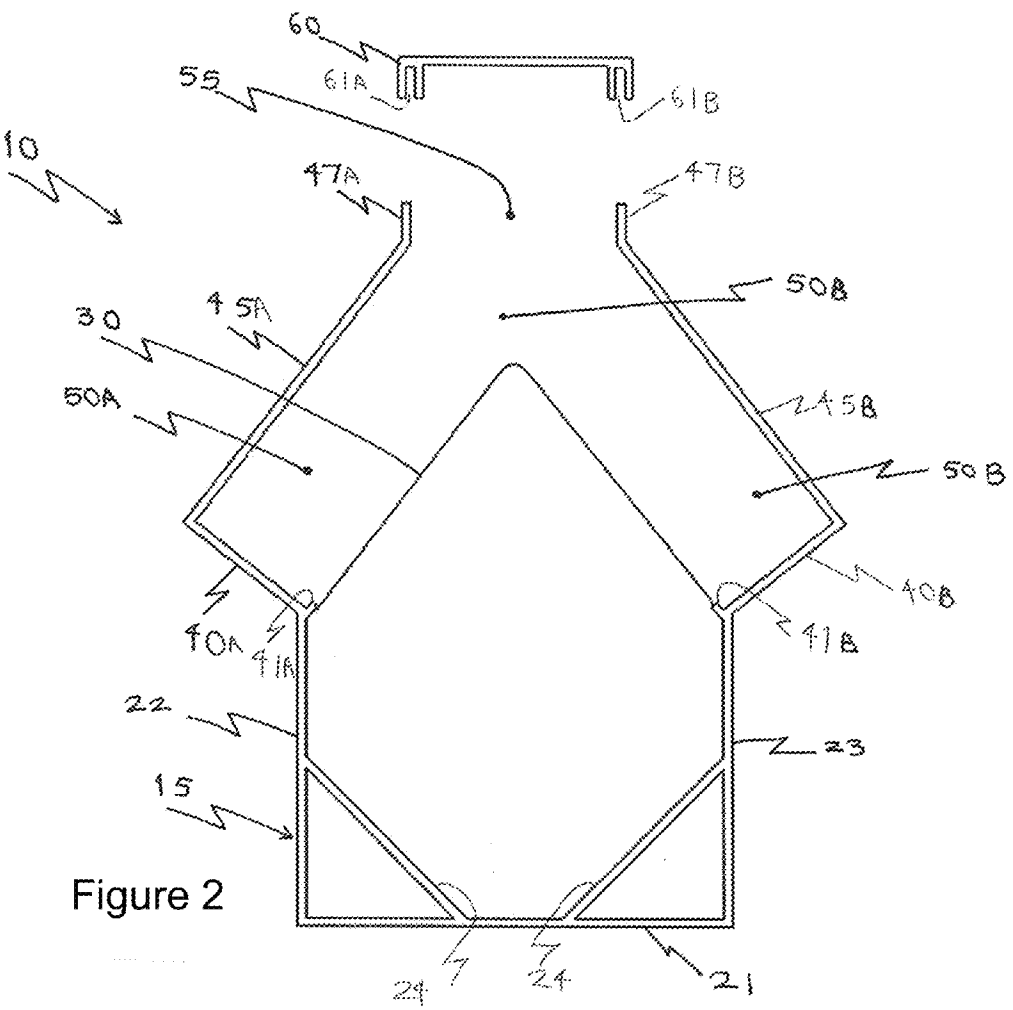
FIG. 2 is a section of the charge of FIG. 1.

Referring first to FIGS. 1 and 2 there is shown a linear cutting charge generally indicated 10.

The charge comprises an elongate body 15, which in this embodiment is formed with a generally square U-shape trough-like body section 20 with a base 21 and two parallel side walls 22, 23.

A pair of elongate inclined cross braces 24 extend longitudinally and join the base 21 and respective walls 22, 23.

Extending, inclined, from the free ends of the section side walls 22, 23 are generally L-section elongate channel flanges 35A, 35B. The short leg 40A, 40B of each channel flange extends from respective walls 22, 23 and the long leg 45A, 45B extends spaced from and generally parallel to each side of the liner section 30 (see below). This forms a generally V-shape cavity 50 in the form of two elongate channels 50A, 50B.

The legs 40A, 40B terminate with truncated flanges 41A, 41B. The legs 45A, 45B each terminate with an inclined flange 47A, 47B which are spaced from each other to define a chute 55.

A generally V-shape linear cutting charge liner 30 is provided and rests on or against the truncated flanges 41. It will be noted that the liner 30 effectively defines a wall of the cavity 50.

Figure 3:
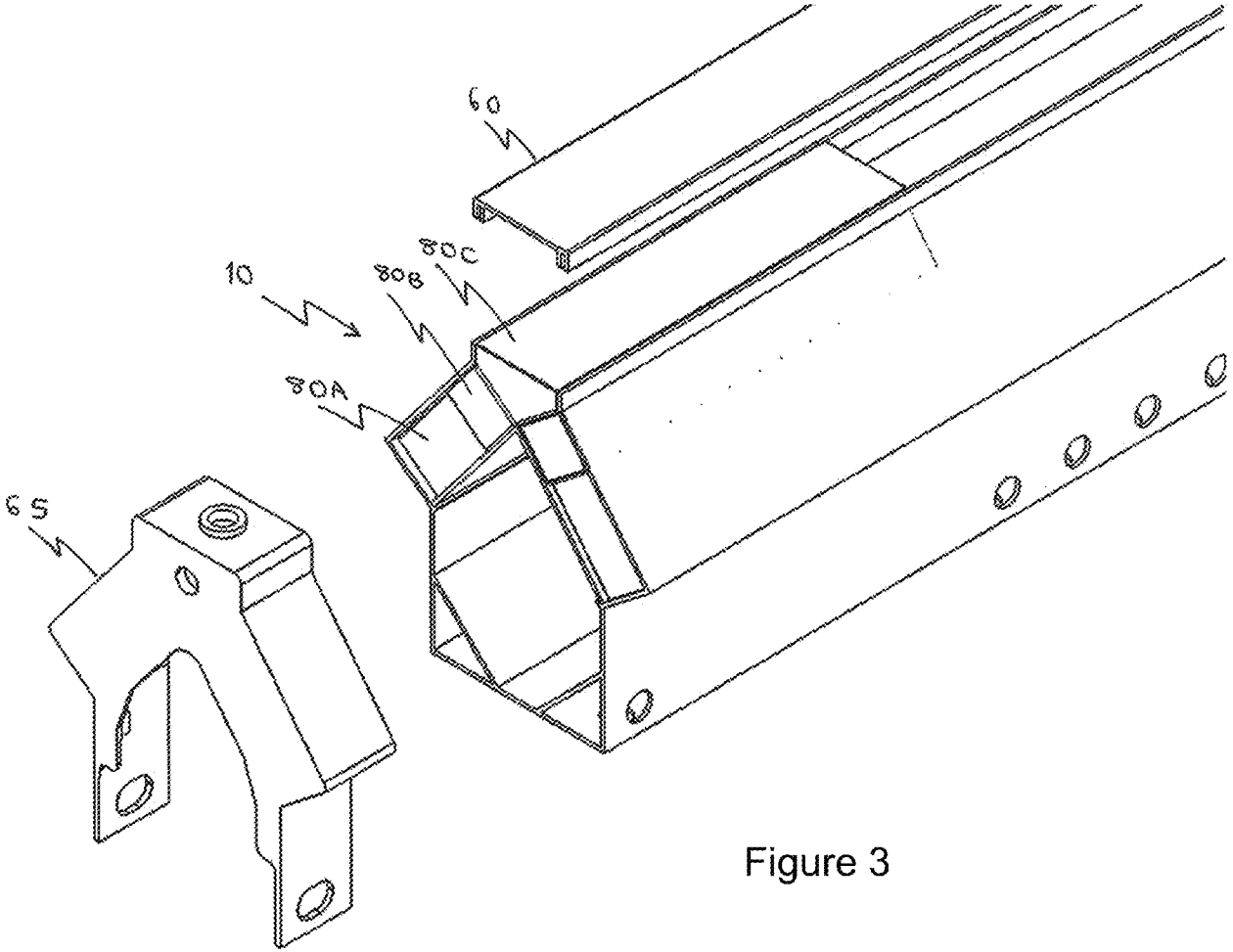
FIG. 3 is a magnified perspective view of one end of the charge of FIG. 1 shown partially assembled.
Figure 4:
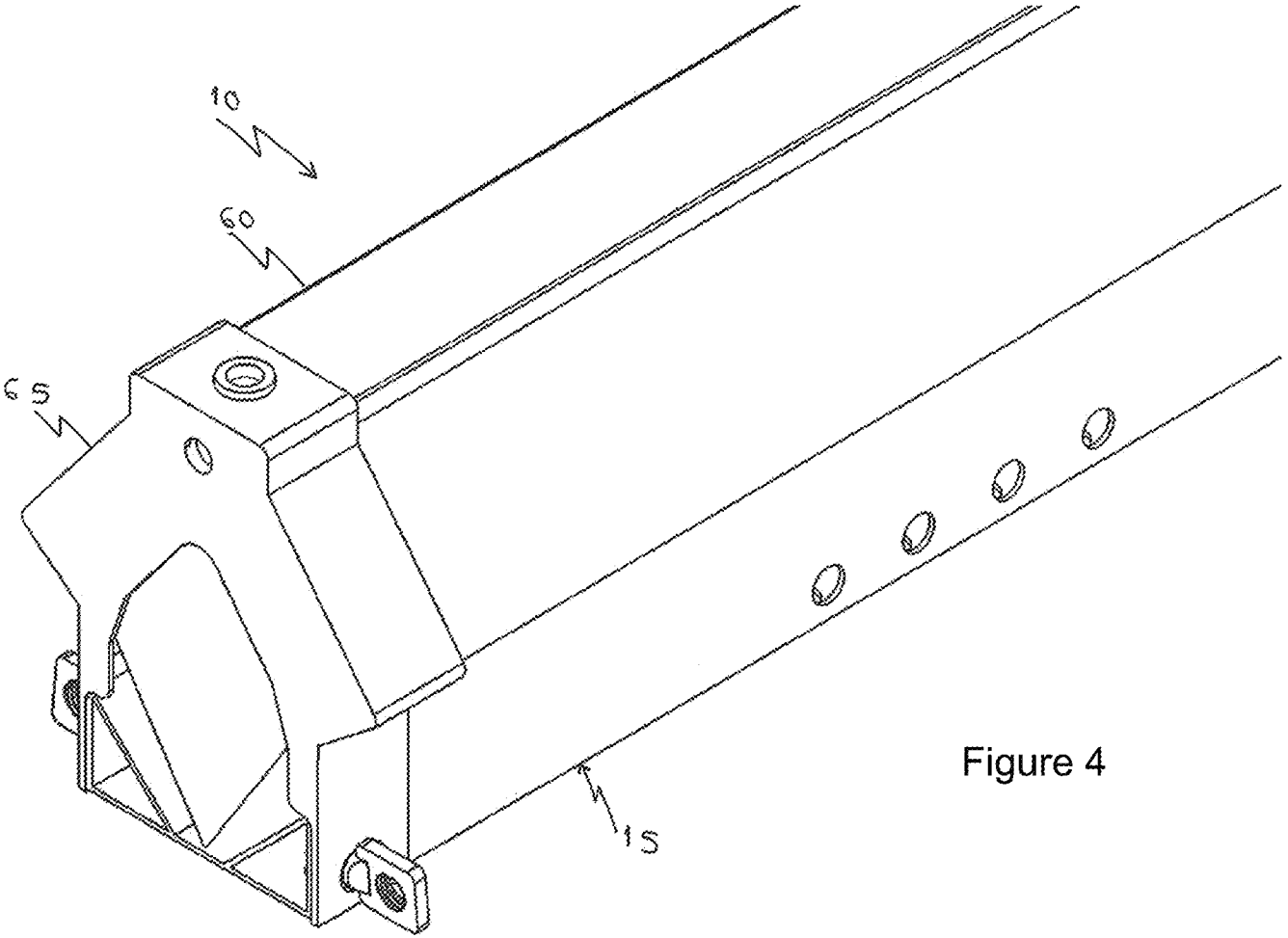
FIG. 4 shows the end of FIG. 3 fully assembled.
Figure 5:
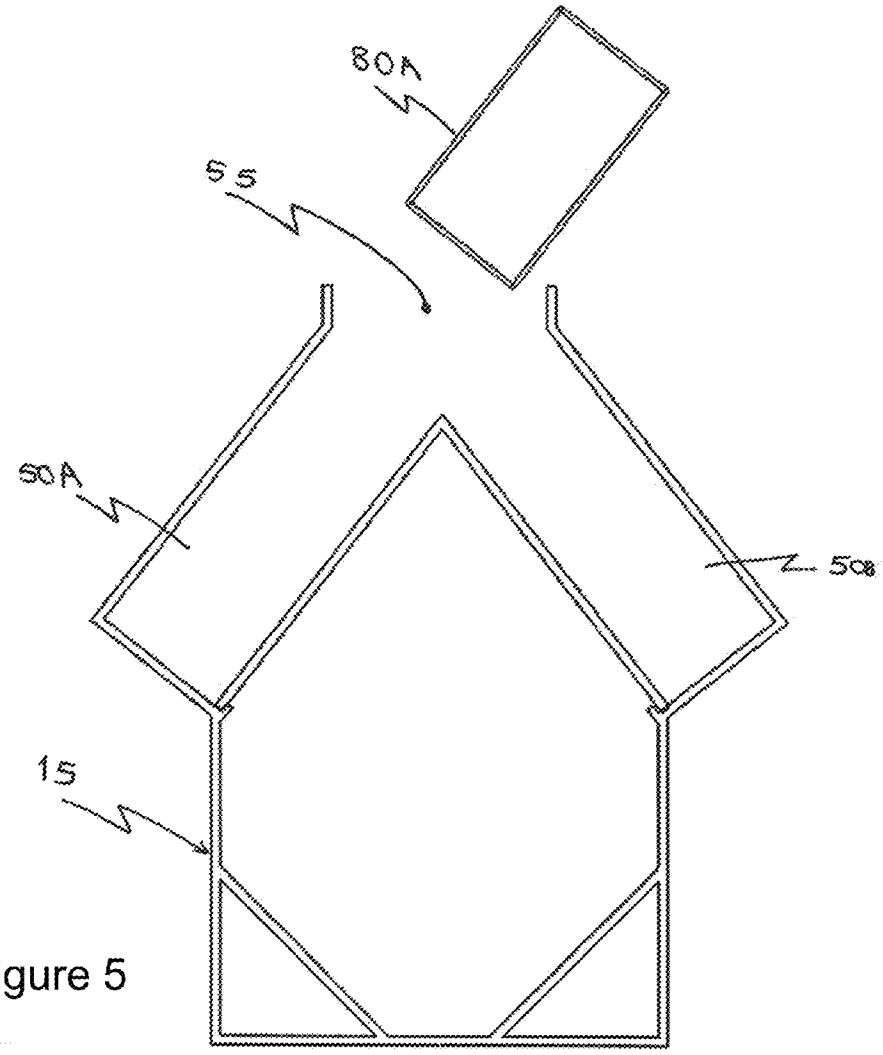
FIGS. 5 to 12 are a sequence of images showing the way in which explosive are incrementally added to a charge.
Figure 6:
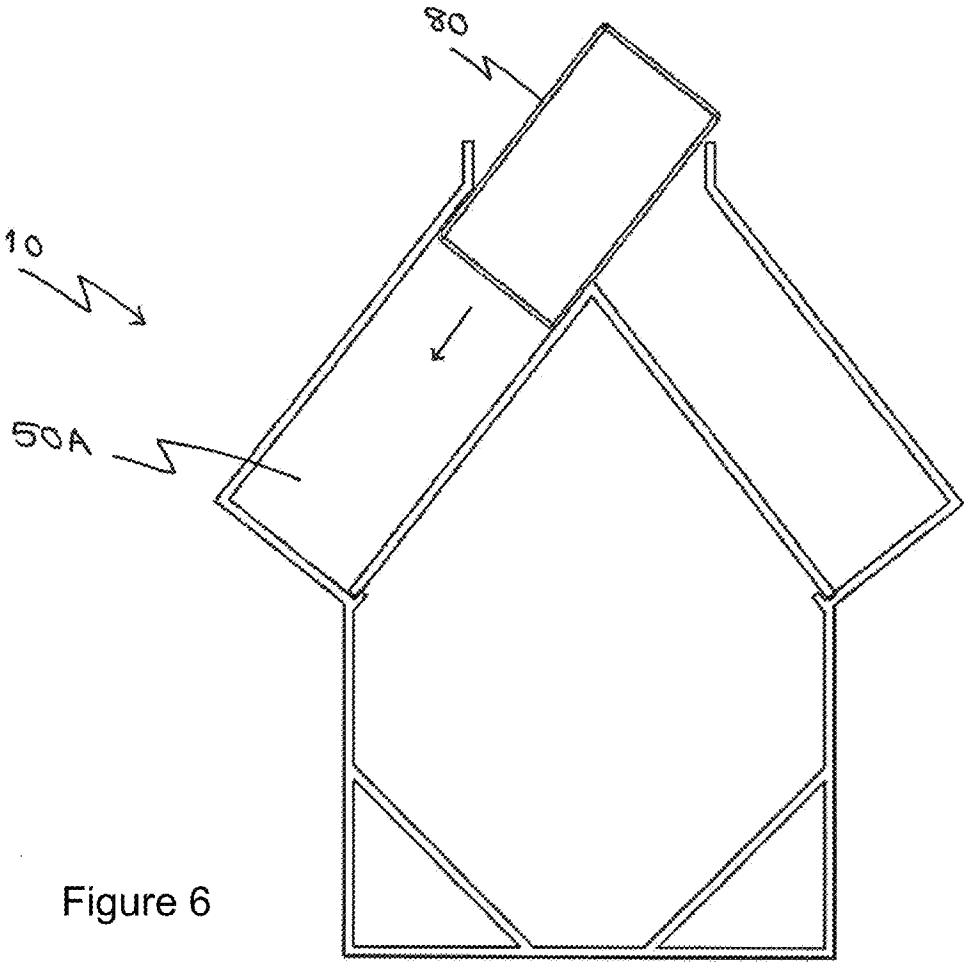
Figure 7:
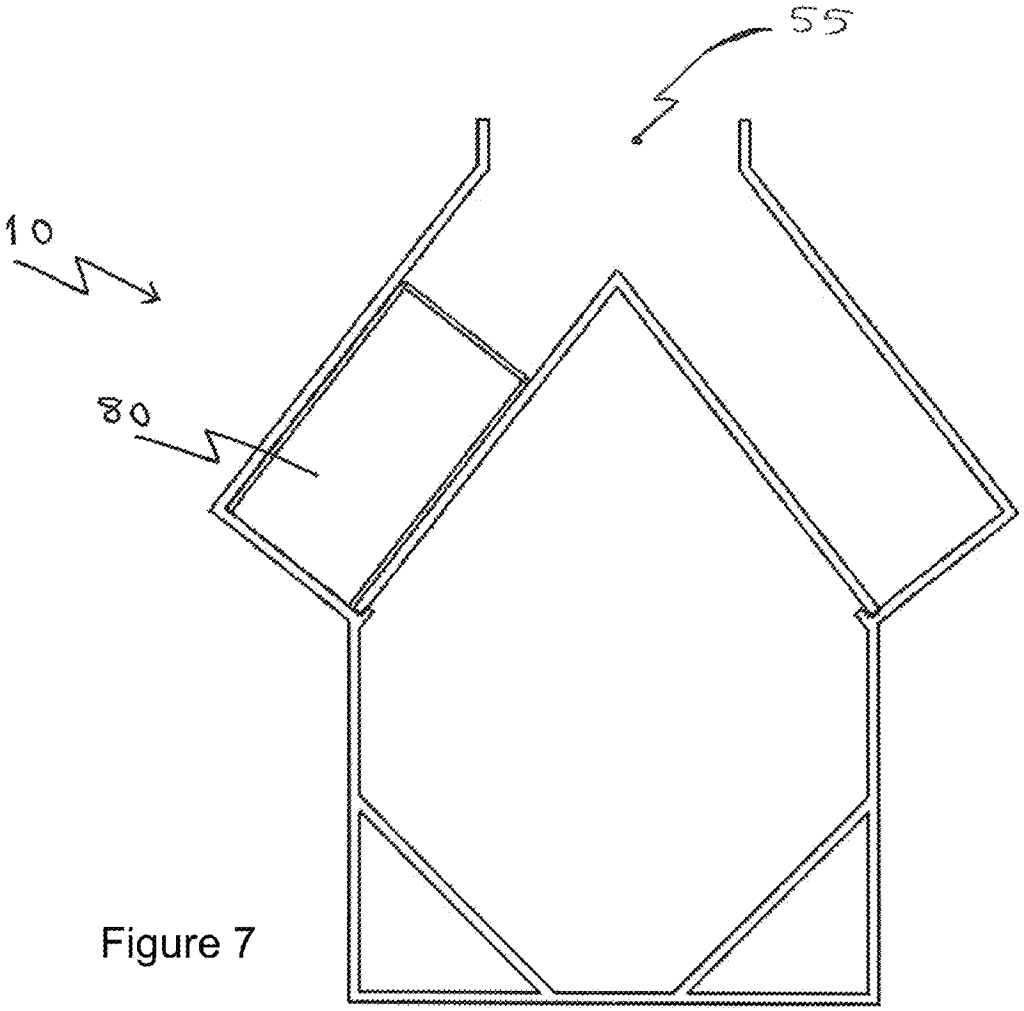
Figure 8:
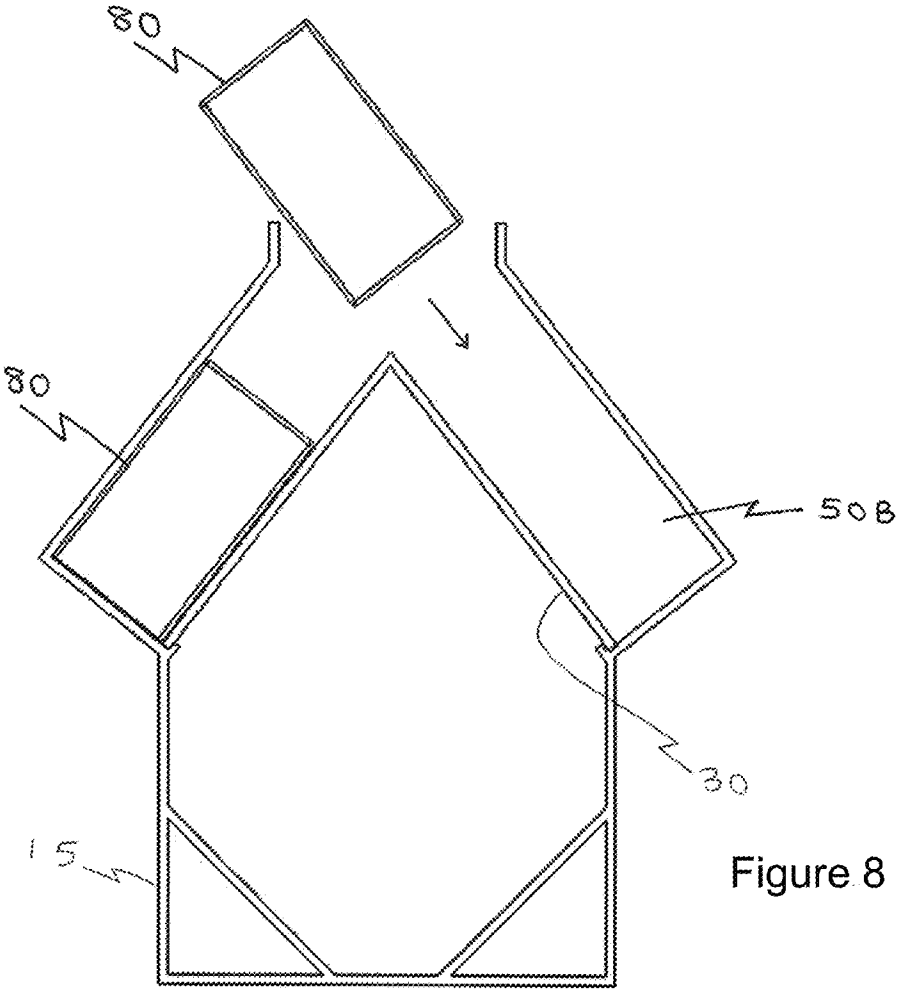

Referring now also to FIGS. 3 and 4, and as described in more detail below, explosive material can be loaded into the cavity 55 through the chute 55.

The explosive is held in place by a lid 60 (in this embodiment formed from a plastics material) and end-caps 65 (only one is shown, in this embodiment formed from a plastics material), which is held in place using screwed-in bolts 70.

The lid, includes a channel 61A, 61B running along each side defining recesses which fit onto the flanges 47A, 47B to fit the lid onto the body 15.

Holes 75 are provided on the bottom edge of the body section 20 to accommodate the bolts to hold the end-caps on (depending on the length to which the body is cut) as well as to provide fixing points for the charge.

FIGS. 5 to 12 are a sequence of images illustrating the way in which explosive material blocks are incrementally added to a charge.

Figure 9:
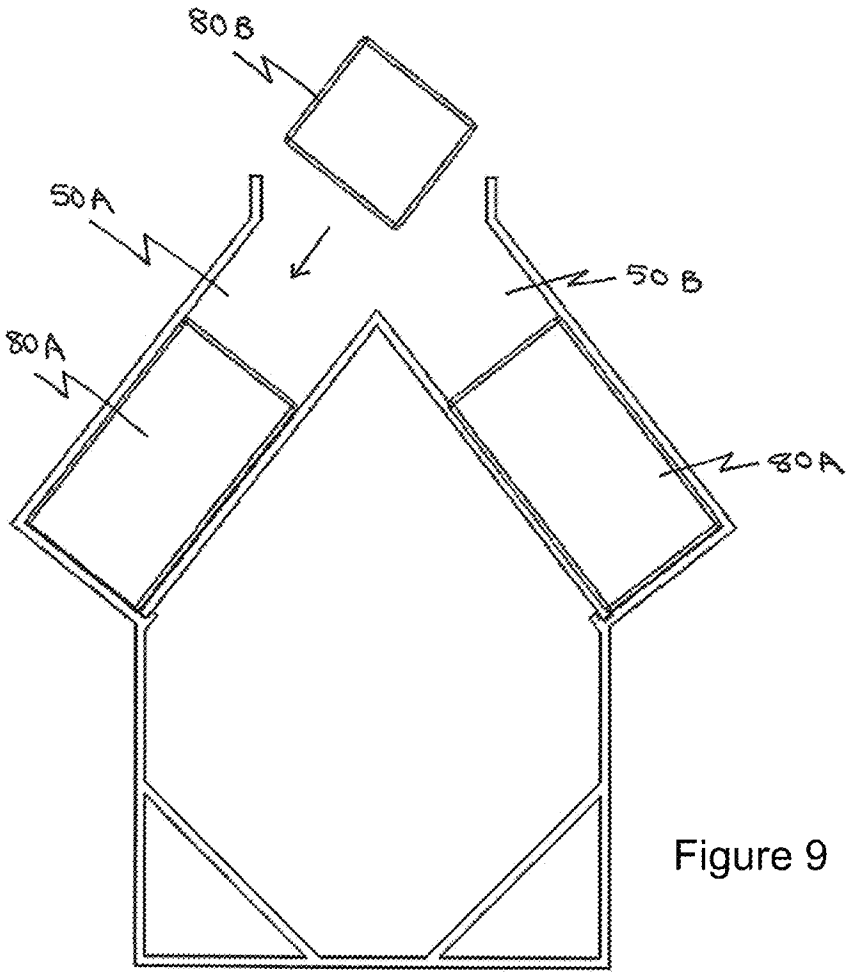
Figure 10:
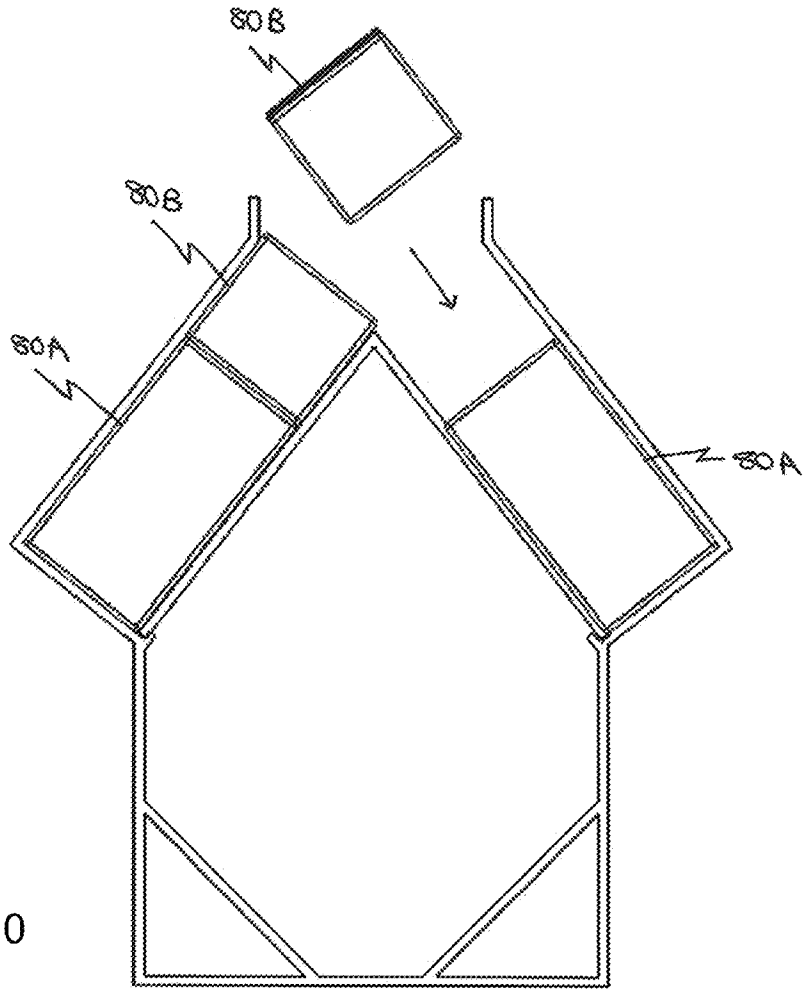
Figure 11:
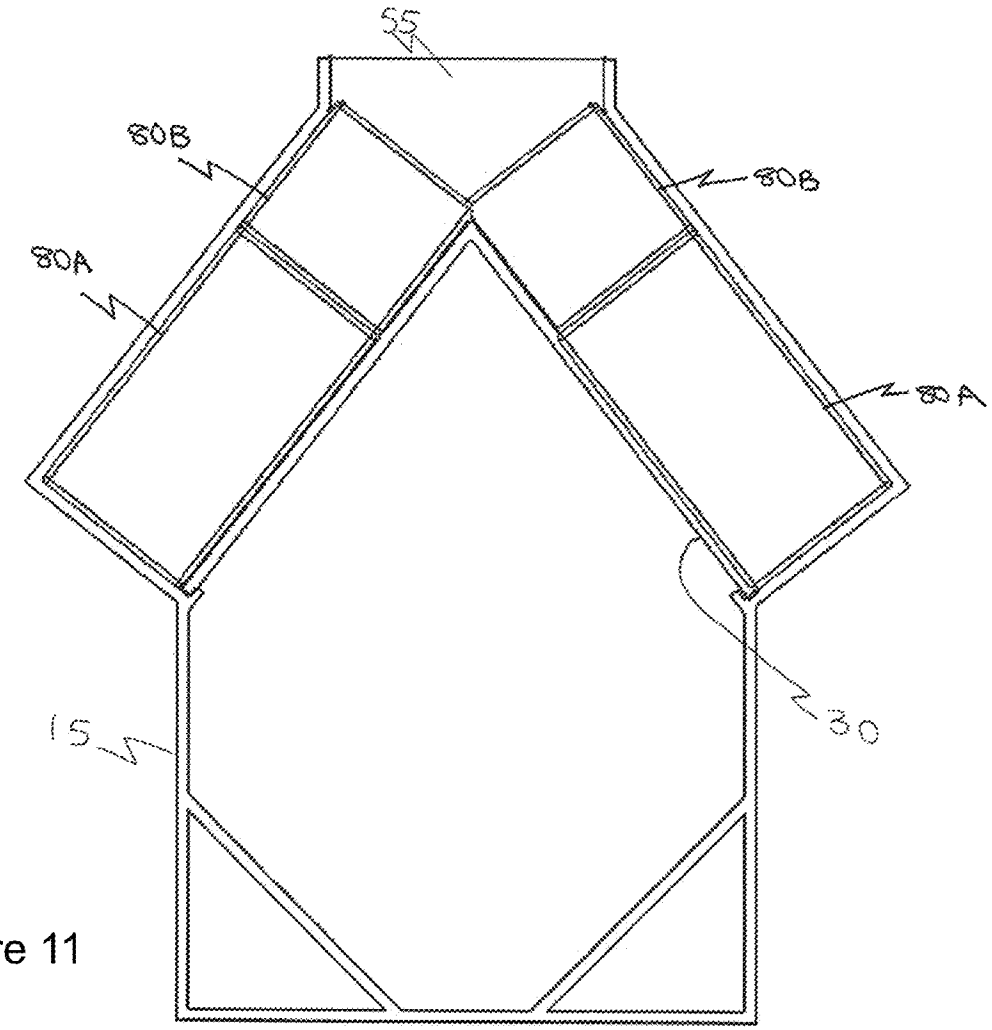

A full block 80A of plastic explosive material is first loaded into each channels 50A, 50B through the chute 55 to start to fill the cavity 50 (FIGS. 5 to 8), followed by a half block 80B (FIGS. 9 to 11)

Figure 12:
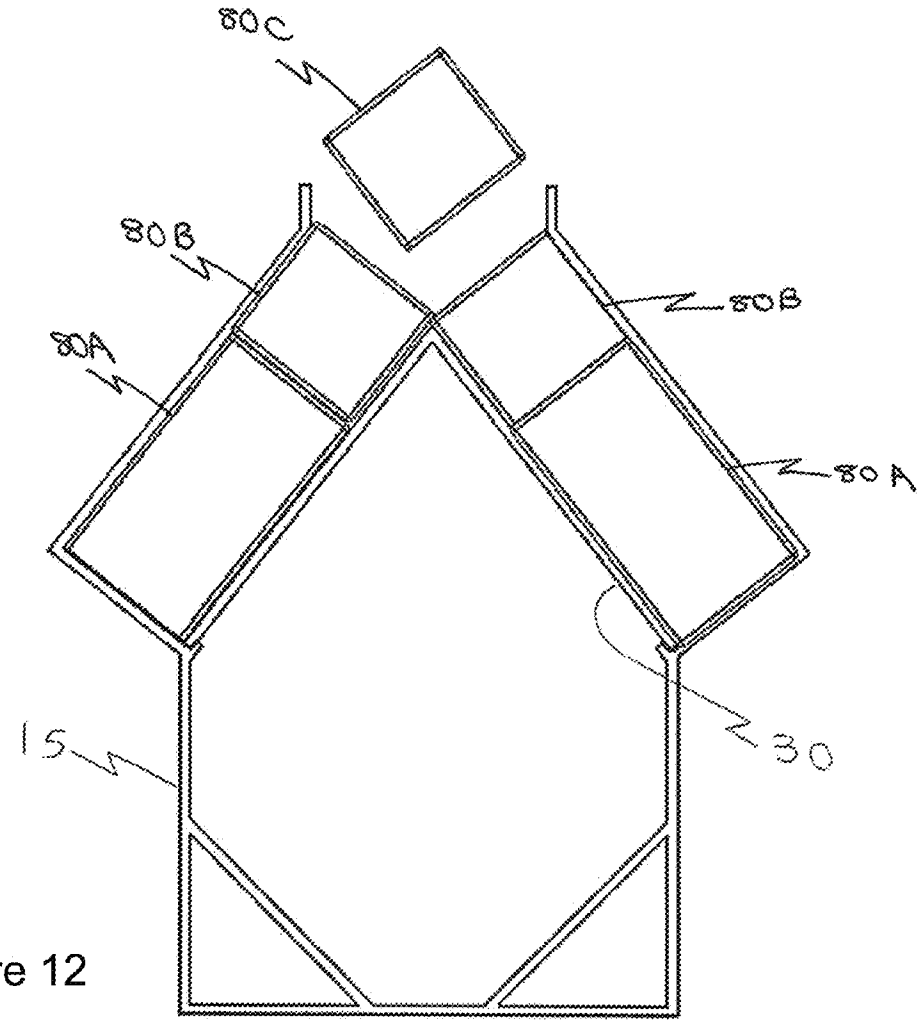

It will be noted from FIG. 12 that in this embodiment only the final piece 80C of explosive would need to be manipulated and reshaped to fill the cavity (as shown in FIG. 3). With the latest plastic explosive, this is very fast and easy. The key here is speed. If the charge can be loaded more quickly, then it is easier to use.

Figure 13:
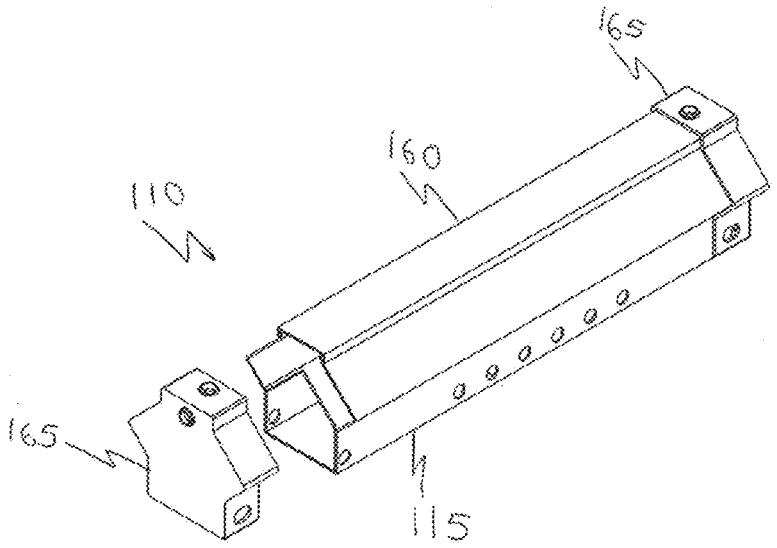
FIG. 13 is a perspective view of a charge formed according to an alternative embodiment and shown with one end cap removed.
Figure 14:
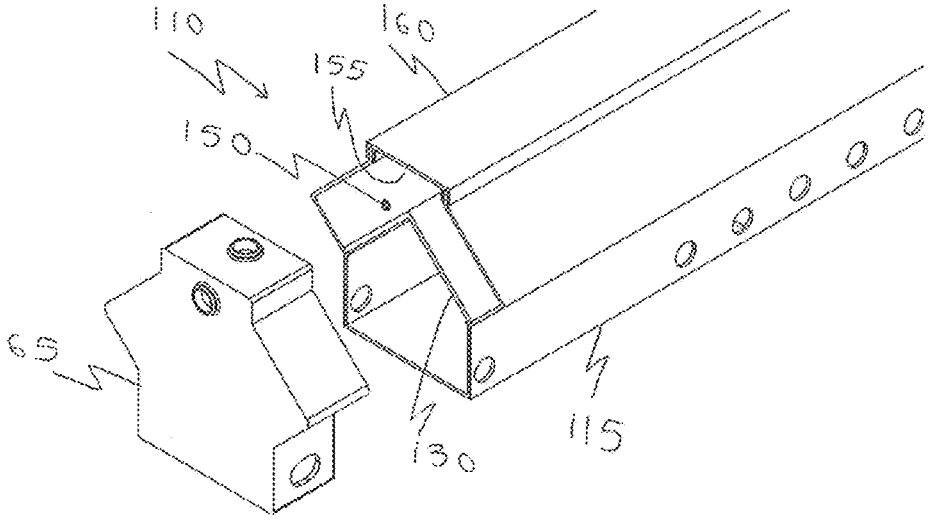
FIG. 14 is an enlarged view of one end of the charge of FIG. 13.
Figure 15:
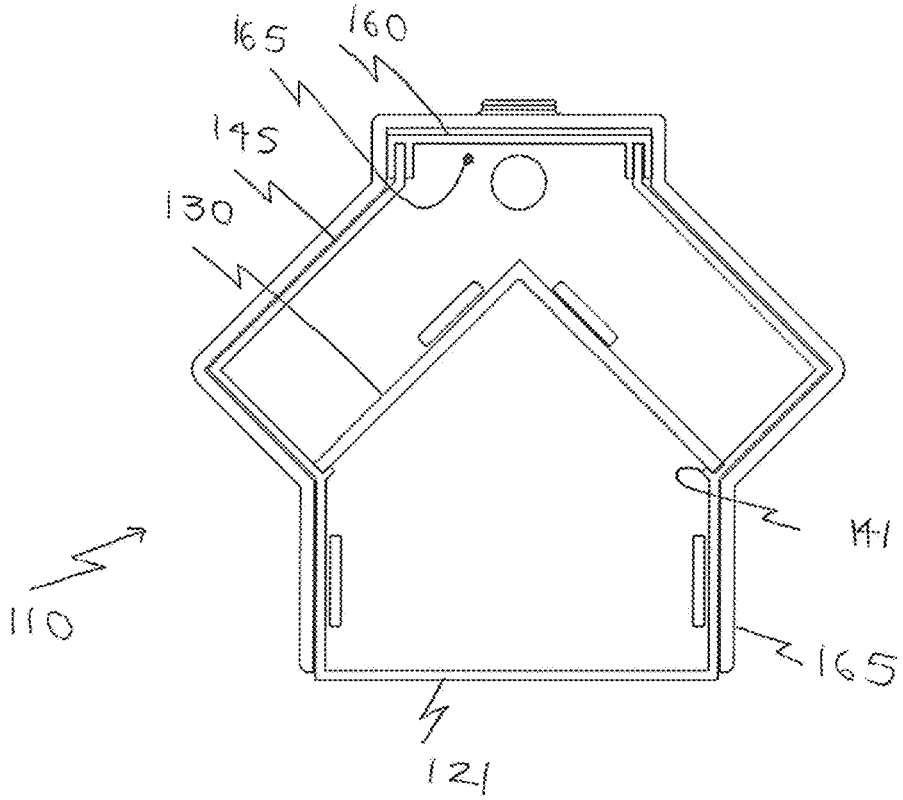
FIG. 15 is a section of one end of the charge of FIG. 13 when fitted with an end cap.

In FIGS. 13 to 15 a charge 110 formed according to an alternative embodiment is shown. The charge 110 is similar to the charge 10 of FIGS. 1 to 12. The body cavity includes longitudinal flange ledges 141 for receiving a generally chevron-shape linear cutting charge liner 130. No cross braces are provided.

End caps 165 are provided to fit over each end of the elongate body. The end caps are provided with holes 166 for receiving fixings (not shown) to secure them to the body.

Figure 16:
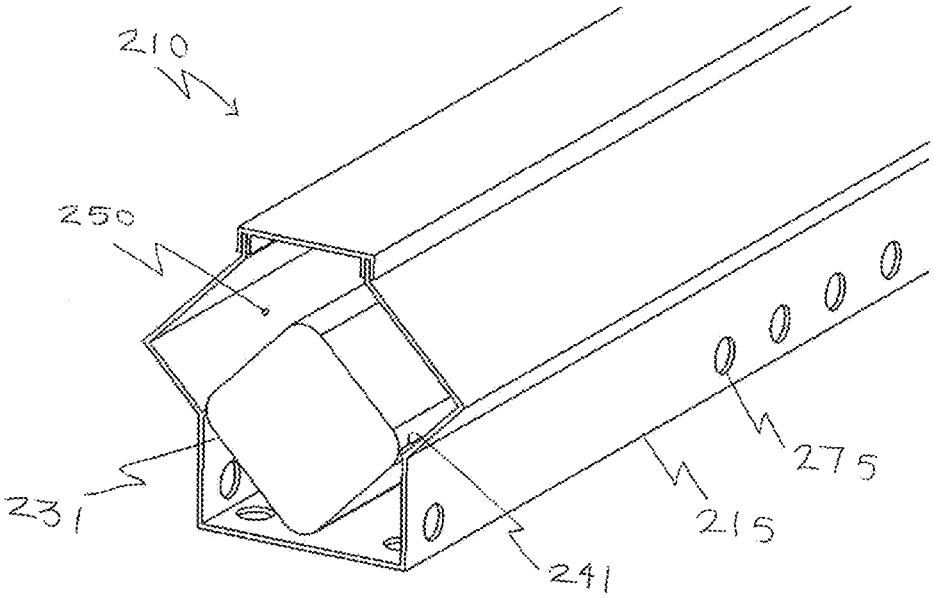
FIG. 16 is a perspective view of one end of a charge formed according to an further embodiment and shown with an end cap removed.
Figure 17:
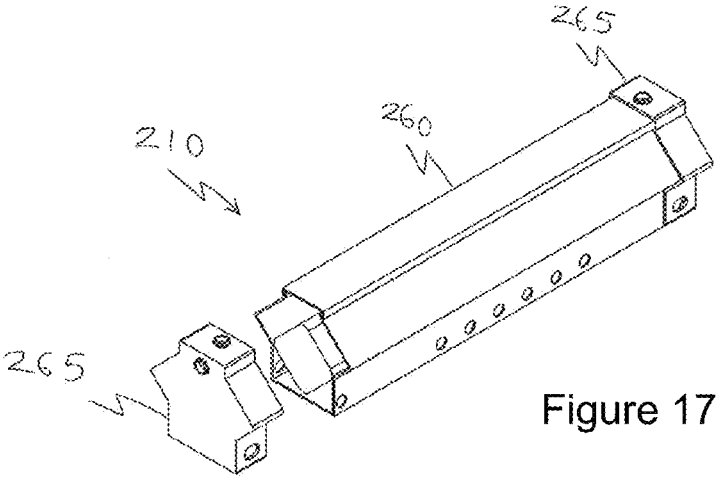
FIG. 17 is a perspective view of the charge of FIG. 17.
Figure 18:
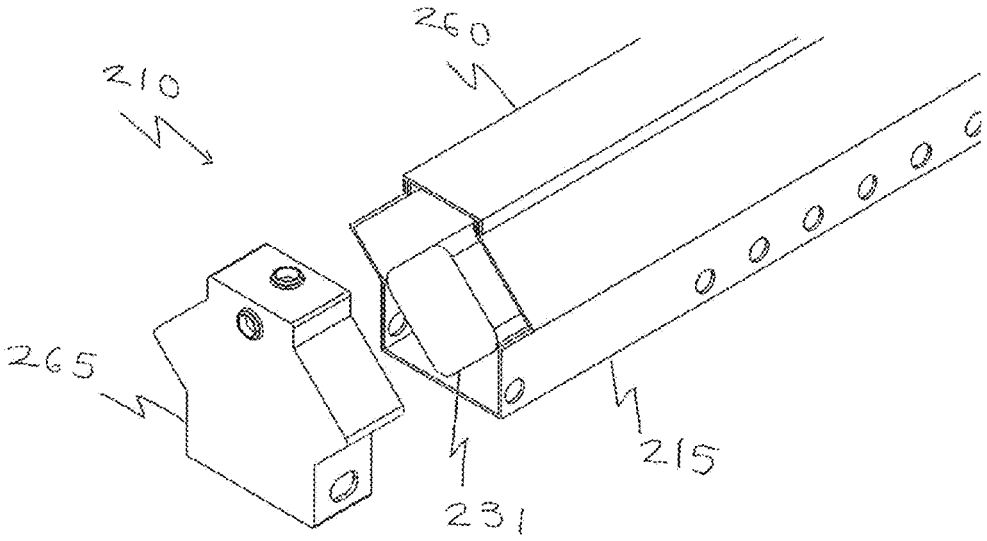
FIG. 18 is an enlarged view of one end of the charge of FIG. 17.

FIGS. 16 to 18 show a charge 210 formed according to an alternative embodiment. The charge 210 is similar to the charge 110 of FIGS. 13 to 15 except that in this embodiment the liner is replaced by a generally box-sectioned liner 231 which is supported on the ledges 241.

Figure 19:
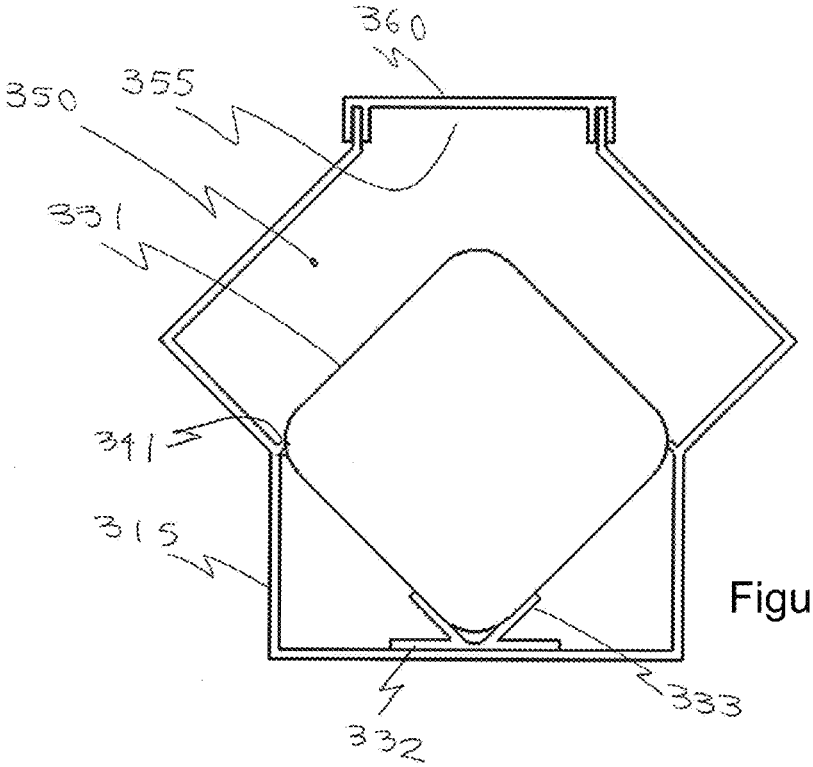
FIG. 19 is a section of one end region of a charge formed according to a further embodiment.
Figure 20:
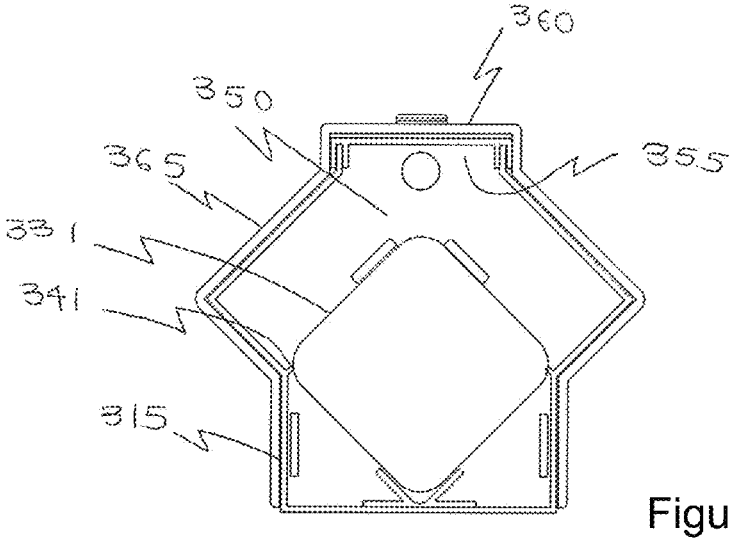
FIG. 20 is a section of the charge of FIG. 19 when fitted with an end cap.

In FIGS. 19 and 20 a further embodiment is shown, in which a charge 310 very similar to the charge 210 is provided with an elongate support 332 including a generally V-section holder 333 upon which a box-sectioned liner 331 rests (together with the ledges 341).

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention as defined by the appended claims and their equivalents.

The invention claimed is:

1. A user-fillable linear shaped charge, comprising an elongate body and a liner, in which the body comprises:

a cavity adjacent at least part of the liner for receiving explosive material, the cavity comprising two elongate channels extending adjacent the liner;

side walls from which inclined L-section elongate channel flanges extend, a short leg of each flange extending from each respective side wall and a long leg spaced from and extending generally parallel to each side of the liner to define the two elongate channels of the cavity; and an elongate delivery opening at an apex of the cavity between the two elongate channels for receiving explosive material.

2. A charge as claimed in claim 1, in which the opening comprises a filling chute.

3. A charge as claimed in claim 1, in which the opening is adapted to receive blocks of explosive material.

4. A charge as claimed in claim 1, in which the liner defines part of the cavity.

5. A charge as claimed in claim 1, in which the liner is a generally V-shape or a generally chevron-shape elongate linear cutting charge liner.

6. A charge as claimed in claim 1, in which the liner is a box-sectioned liner.

7. A charge as claimed in any claim 1, in which the liner is a separate component.

8. A charge as claimed in claim 1, in which the liner is an integral part of the body.

9. A charge as claimed in claim 1, further comprising a lid for covering the opening.

10. A charge as claimed in claim 1, further comprising an end cap at either or both ends of the elongate body.

11. A charge as claimed in claim 1, in which the charge has or comprises a sealed projection unit.

12. A charge as claimed in claim 1, in which the position of the liner can be varied within the body.

13. A linear shaped charge, comprising an elongate body and an elongate liner provided on or by the body, in which the body comprises:

a longitudinal cavity adjacent the liner and fillable with explosive material, the cavity comprising two elongate channels extending adjacent the liner;

side walls from which inclined L-section elongate channel flanges extend, a short leg of each flange extending from each respective side wall and a long leg spaced from and extending generally parallel to each side of the liner to define the two elongate channels of the cavity; and a longitudinal delivery chute at an apex of the cavity between the two elongate channels and leading to the longitudinal cavity and through which the explosive material can be filled.

14. A charge as claimed in claim 1, wherein the channels are inclined downwards from the delivery opening, and wherein the channels extend beyond the walls of the delivery opening.

15. A charge as claimed in claim 13, in which the delivery chute is adapted to receive blocks of explosive material.

16. A charge as claimed in claim 13, in which the liner defines part of the cavity.

17. A charge as claimed in claim 13, in which the liner is: a generally V-shape: or generally chevron-shape elongate linear cutting charge liner; or a box-sectioned liner.

18. A charge as claimed in claim 13, further comprising a longitudinal lid for covering the longitudinal delivery chute.

19. A charge as claimed in claim 13, in which the elongate body is open at both ends and the charge further comprises an end cap for either or both ends of the elongate body.

20. A charge as claimed in claim 13, wherein the channels are inclined downwards from the delivery chute, and wherein the channels extend beyond the walls of the delivery chute.

* * * * *